US005305018A

United States Patent [19]

Schantz et al.

[11] Patent Number: 5,305,018

[45] Date of Patent: Apr. 19, 1994

[54] EXCIMER LASER-ABLATED COMPONENTS FOR INKJET PRINTHEAD

[75] Inventors: Christopher A. Schantz, Redwood City, Calif.; William Lloyd, Tokyo, Japan; Eric Hanson, Burlingame, Calif.

[73] Assignee: Hewlett-Packard Company, Palo Alto, Calif.

[21] Appl. No.: 849,650

[22] Filed: Mar. 9, 1992

Related U.S. Application Data

[63] Continuation of Ser. No. 568,000, Aug. 16, 1990, abandoned.

[51] Int. Cl.[5] ..... B41J 2/16

[52] U.S. Cl. ..... 346/1.1; 29/890.1; 219/121.71; 346/140 R

[58] Field of Search ..... 346/140, 1.1; 219/121.7, 121.71; 29/890.1

[56] References Cited

U.S. PATENT DOCUMENTS

| | | | |
|---|---|---|---|
| 4,312,009 | 1/1982 | Lange | 346/140 |
| 4,450,455 | 5/1984 | Sugitani | 346/140 |
| 4,490,728 | 12/1984 | Vaught et al. | 346/1.1 |
| 4,500,895 | 2/1985 | Buck | 346/140 |
| 4,502,060 | 2/1985 | Rankin et al. | 346/140 |
| 4,550,326 | 10/1985 | Allen | 346/140 |
| 4,558,333 | 12/1985 | Sugitani | 346/140 |
| 4,568,953 | 2/1986 | Aoki et al. | 346/140 |
| 4,580,149 | 4/1986 | Domoto | 346/140 R |
| 4,587,534 | 5/1986 | Saito | 346/140 |
| 4,611,129 | 9/1986 | Sugitani | 346/140 |
| 4,695,854 | 9/1987 | Cruz-Uribe | 346/140 |
| 4,712,172 | 12/1987 | Kiyohara et al. | 346/1.1 |
| 4,734,717 | 3/1988 | Rayfield | 346/140 |
| 4,746,935 | 5/1988 | Allen | 346/140 |
| 4,780,177 | 10/1988 | Wojnarowski | 156/643 |
| 4,847,630 | 7/1987 | Bhaskar | 346/140 X |
| 4,914,736 | 4/1990 | Matsuda | 346/140 R |
| 4,915,981 | 4/1990 | Traskos | 156/643 X |
| 4,942,408 | 7/1990 | Braun | 346/140 |
| 5,025,552 | 6/1991 | Yamaoka | 219/121.71 X |

FOREIGN PATENT DOCUMENTS

| | | | |
|---|---|---|---|
| 309146 | 3/1989 | European Pat. Off. . | |
| 0367541A2 | 10/1989 | European Pat. Off. | B41J 2/16 |
| 170350 | 7/1987 | Japan . | |

OTHER PUBLICATIONS

Green, J. W.; Manufacturing Method for Inkjet Nozzles; IBM TDB, V24, N5, October 1981, pp. 2267-2268.

Nielsen, Niels J., "History of Thinkjet Printhead Development," Hewlett-Packard Journal, May 1985, pp. 4-7.

Znotins, Thomas A., "Excimer Lasers: An Emerging Technology in Materials Processing", Laser Focus-/Electro-Opics, May 1987, pp. 54-70.

Srinivasan, R. et al., "Self-Developing Photoetching of Poly(ethylene Terephthalate) Films By Far-ultraviolet Excimer Laser Radiation", Appl. Phys. Letter, Sep. 15, 1992, pp. 576-577.

Srinivasan, V. et al., "Excimer Laser Etching Of Polymers", J. Appl. Phys., Jun. 1, 1986, pp. 3861-3867.

Yeh, J. T. C., "Laser Ablation Of Polymers", J. Vac. Sci. Technol. A, May/Jun. 1986, pp. 653-658.

Srinivasan, R., "Kinetics Of The Ablative Photodecomposition Of Organic Polymers In The Far-Ultraviolet (193nm)", J. Vac. Sci. Technol. B, Oct.-Dec. 1983, pp. 923-926.

Crowley et al.; Nozzles For Ink Jet Printers; IBM TDB, V25, N8, Jan. 1983, p. 4371.

*Primary Examiner*—Joseph W. Hartary

[57] ABSTRACT

An inkjet printhead includes a nozzle plate formed of a polymer material that has been photoablated or photoetched to form inkjet nozzles. The polymer material preferably is a plastic such as teflon, polyimide, polymethylmethacrylate, polyethyleneterephthalate or mixtures thereof. The nozzle plate also has formed in it a plurality of vaporization chambers. The inkjet nozzles are preferably formed in a flexible strip of polymer film by masked laser radiation, where the mask is physically spaced from the polymer film. Heater resistors may be formed on the nozzle plate within each of the vaporization chambers.

3 Claims, 3 Drawing Sheets

EXCIMER LASER-ABLATED COMPONENTS FOR INKJET PRINTHEAD

This is a continuation of copending application Ser. No 07/568,00 filed on Aug. 16, 1990, now abandoned.

BACKGROUND OF THE INVENTION

1. Field of the Invention

The present invention generally relates to inkjet printers and, more particularly, to nozzle plates and other components for the printheads of inkjet printers.

2. State of the Art

FIG. 1 shows an example of a conventional printhead for an inkjet printer. The printhead includes a substrate 11, an intermediate layer 14, and an nozzle plate 12. As further shown in the drawing, a nozzle orifice 13 is formed in plate 12 and a vaporization cavity 15 is formed in substrate 11. For convenience of illustration, the drawing shows only one of the orifices 13 and only one of the vaporization cavities 15; however, a complete inkjet printhead includes an array of circular orifices, each of which is paired with a vaporization cavity. Also, a complete inkjet printhead includes means that connect a number of vaporization cavities to a single ink supply reservoir.

As further shown in FIG. 1, a heater resistor 16 of the thin-film type is mounted on substrate 11 and is positioned generally centrally within vaporization cavity 15 such that the heater resistor can be seen when the vaporization cavity is viewed from above. In practice, such heater resistors can be formed on a silicon or glass substrate, for example, by sputtering or vapor deposition techniques. Conventional printheads for inkjet printers include one such heater resistor in each vaporization cavity and the heater resistors are connected in an electrical network for selective activation.

In operation of a inkjet printhead such as shown in FIG. 1, pulses of electrical energy are directed to selected ones of the heater resistors 16. When a particular heater resistor receives a pulse, it rapidly converts the electrical energy to heat which, in turn, causes any ink immediately adjacent to the heater resistor to form an ink vapor bubble. As an ink vapor bubble expands, it ejects a droplet of ink from the orifice in the nozzle plate above the energized heater resistor. To illustrate such action, FIG. 1 shows an ink vapor bubble 17 and an ink droplet 19.

By appropriate selection of the sequence for energizing the heater resistors in an inkjet printhead such as shown in FIG. 1, ejected ink droplets can be caused to form patterns on a paper sheet or other suitable recording medium. For example, a pattern of heater resistors can be energized such that the ejected ink drops form images that depict alphanumeric characters.

For inkjet printers, print quality depends upon the physical characteristics of the nozzles in a printhead. For example, the geometry of the orifice nozzles in a printhead affects the size, trajectory, and speed of ink drop ejection. In addition, the geometry of orifice nozzles in a printhead can affect the flow of ink supplied to vaporization chambers and, in some instances, can affect the manner in which ink is ejected from adjacent nozzles.

Nozzle plates for inkjet printheads often are formed of nickel and are fabricated by lithographic electroforming processes. One example of a suitable lithographic electroforming processes is described in U.S. Pat. No. 4,773,971. In such processes, the orifices in a nozzle plate are formed by overplating nickel around pillars of photoresist.

Such electroforming processes for forming nozzle plates for inkjet printheads have several shortcomings. One shortcoming is that the processes require delicate balancing of parameters such as photoresist and plating thicknesses, pillar diameters, and overplating ratios. Another shortcoming is that the resulting nozzle plates usually are brittle and easily cracked. Still another shortcoming is that such electroforming processes inherently limit design choices for nozzle shapes and sizes.

When using electroformed nozzle plates and other components in printheads for inkjet printers, corrosion can be a problem. Generally speaking, corrosion resistance of such nozzle plates depends upon two parameters: ink chemistry and the formation of a hydrated oxide layer on the electroplated nickel surface of an nozzle plate. Without a hydrated oxide layer, nickel may corrode in the presence of inks, particularly water-based inks such as are commonly used in inkjet printers. Although corrosion of nozzle plates ca be minimized by coating the plates with gold, such plating is costly.

Yet another shortcoming of electroformed nozzle plates for inkjet printheads is that the completed printheads have a tendency to delaminate during use. Usually, delamination begins with the formation of small gaps between a nozzle plate and its substrate. The gaps are often caused by differences in thermal expansion coefficients of a nozzle plate and its substrate. Delamination can be exacerbated by ink interaction with printhead materials. For instance, the materials in an inkjet printhead may swell after prolonged exposure to water-based inks, thereby changing the shape of the printhead nozzles.

Even partial delamination of a nozzle plate of an inkjet printhead can be problematical. Partial delamination can, for example, reduce the velocity of ejected ink drops. Also, partial delamination can create accumulation sites for air bubbles that interfere with ink drop ejection. Moreover, partial delamination of a nozzle plate usually causes decreased and/or highly irregular ink drop ejection velocities.

SUMMARY OF THE INVENTION

Generally speaking, the present invention provides improved printheads for inkjet printers. In one of the preferred embodiments, an inkjet printhead includes a nozzle plate formed of a polymer material that has been photo-ablated or photo-etched to form inkjet nozzles. (The terms photo-ablation and photoetching are used interchangeably herein.) The polymer material preferably is a plastic such as teflon, polyimide, polymethylmethacrylate, polyethyleneterephthalate or mixtures and combinations thereof.

In the preferred embodiment, the inkjet nozzles are formed in a flexible strip of polymer film which has been unreeled under a source of masked radiation.

In one particular embodiment of the present invention, the nozzles in the nozzle plate each have a barrel aspect ratio (i.e., the ratio of nozzle diameter to nozzle length) less than about one-to-one: One advantage of decreasing the barrel aspect ratio or, equivalently, extending the barrel length of a nozzle relative to its diameter, is that orifice-resistor positioning in a vaporization cavity is less critical. Another advantage of decreasing the barrel aspect ratio is that nozzles with smaller barrel aspect ratios have less tendency to entrap air bubbles within a vaporization cavity.

In a further particular embodiment of the present invention a heater resistor is mounted directly to a photo-ablated nozzle plate within a vaporization cavity.

BRIEF DESCRIPTION OF THE DRAWINGS

The present invention can be further understood by reference to the following description and attached drawings which illustrate the preferred embodiment. In the drawings.

DETAILED DESCRIPTION OF PREFERRED EMBODIMENTS

Figure 1:
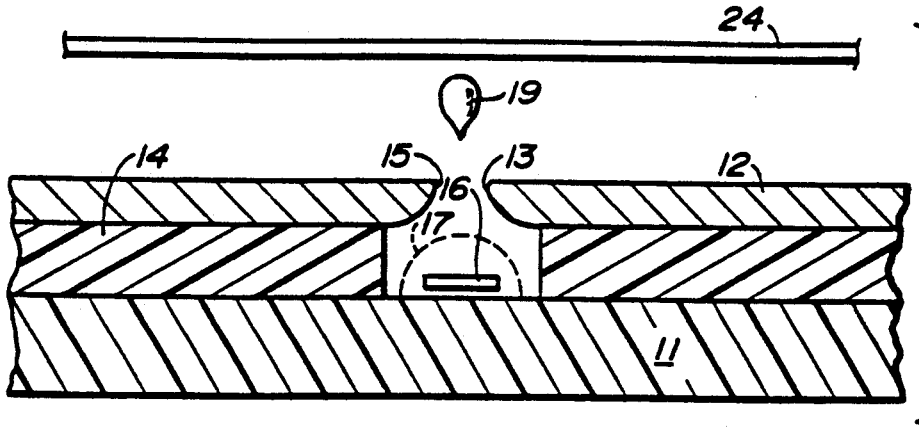
FIG. 1 (PRIOR ART)
FIG. 1 is a cross-sectional view of a section of an inkjet printhead according to the prior art.
Figure 2:
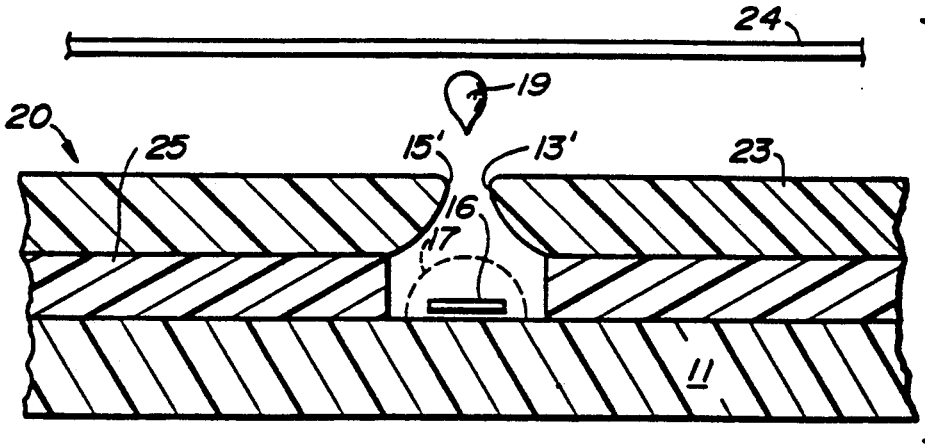
FIG. 2 is a cross-sectional view of a section of an inkjet printhead according to the present invention.

FIG. 2 shows an inkjet printhead, generally designated by the number 20, including a polymer nozzle plate 23 laminated to an intermediate layer 25. Although the inkjet printhead of FIG. 1 has somewhat the same appearance as the inkjet printhead of FIG. 2, the latter printhead is different in that it is formed of a polymer material that has been photo-ablated or photo-etched. The polymer material preferably is a plastic such as teflon, polyimide, polymethylmethacrylate, polyethyleneterephthalate or mixtures thereof.

In practice, various conventional techniques can be employed for photo-ablating or photo-etching the polymer nozzle plate of FIG. 2. Acceptable techniques include, for instance, an ablation process using a high-energy photon laser such as the Excimer laser. The Excimer laser can be, for example, of the $F_2$, ArF, KrCl, KrF, or XeCl type.

Figure 5:
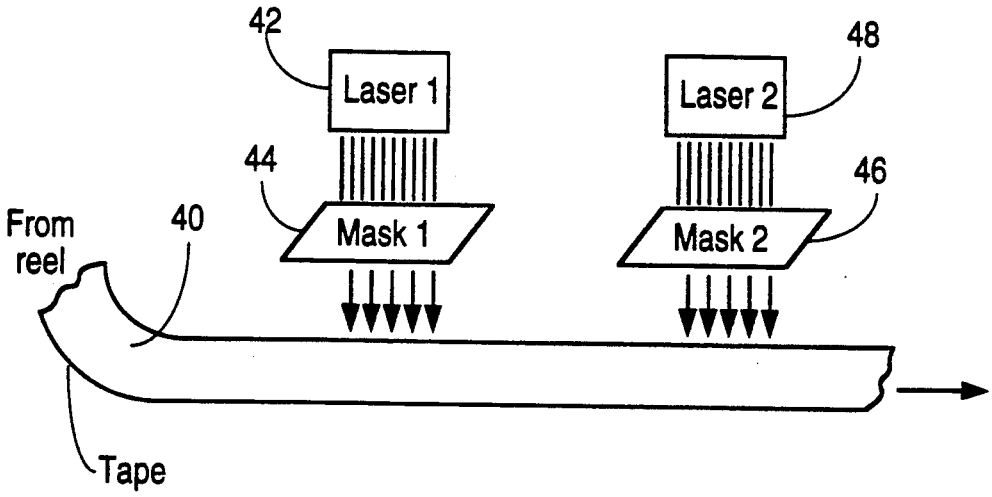
FIG. 5 illustrates a preferred method for forming one or more nozzle members in a strip of flexible tape.

One particular example of a photo-ablation technique for forming the nozzle plate 23 of FIG. 2 is reel-to-reel photo-ablation, as shown in FIG. 5. In such a process, a strip of polymer film 40 is unreeled under a laser 42 while a metal lithographic mask 44 is interposed between, the film 40 and the laser 40 for defining areas of the film 40 that are to be exposed for photo-degradation (i.e., photo-ablation) and areas that are not to be exposed. In practice, the metal lithographic mask 44 preferably is physically spaced from the film 40 during ablation.

Photo-ablation process have numerous advantages as compared to conventional lithographic electroforming processes for forming nozzle plates for inkjet printheads. For example, photo-ablation processes generally are less expensive and simpler than conventional lithographic electroforming processes. In addition, by using photo-ablations processes, polymer nozzle plates can be fabricated in substantially larger sizes (i.e., having greater surface areas) and with nozzle geometries (i.e., shapes) that are not practical with conventional electroforming processes. In particular, unique nozzle shapes can be produced by making multiple exposures with a laser beam being reoriented between each exposure. Also, precise nozzle geometries can be formed without process controls as strict as are required for electroforming processes.

Another advantage of forming nozzle plates by photo-ablating polymers is that the nozzle plates can be fabricated easily with ratios of nozzle length (L) to nozzle diameter (D) greater than conventional. In the preferred embodiment, the L/D ratio exceeds unity. One advantage of extending a nozzle's length relative to its diameter is that orifice-resistor positioning in a vaporization cavity becomes less critical. Another advantage of nozzles with greater L/D ratios is that such nozzles have less tendency to "gulp" air bubbles into the vaporization cavities during operation of the inkjet printhead.

In use, photo-ablated polymer nozzle plates for inkjet printers also have characteristics that are superior to conventional electroformed nozzle plates. For example, photo-ablated polymer nozzle plates are highly resistant to corrosion by water-based printing inks. Also, photo-ablated polymer nozzle plates are generally hydrophobic. Further, photo-ablated polymer nozzle plates are relatively compliant and, therefore, resist delamination. Still further, photo-ablated polymer nozzle plates can be readily fixed to, or formed with a polymer substrate.

Figure 3:
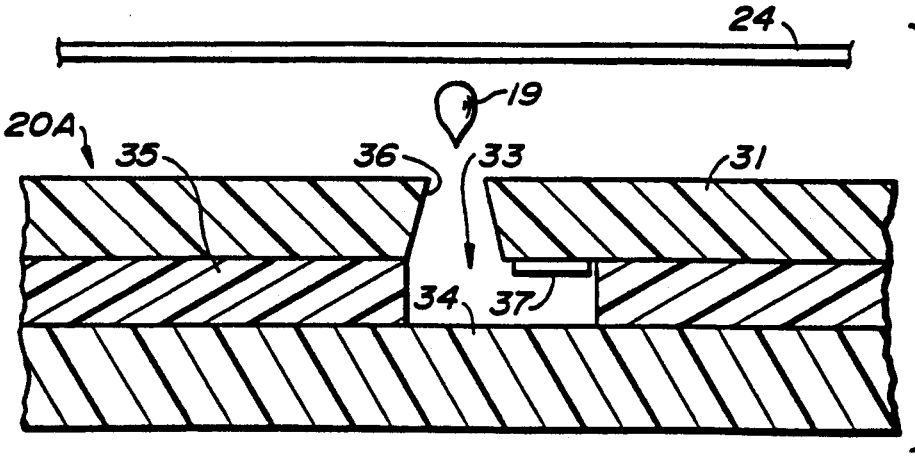
FIG. 3 is a cross-sectional view of an alternate embodiment of an inkjet printhead in accordance with the present invention.

FIG. 3 shows an alternate embodiment of an inkjet printhead of the type including a polymer photo-ablated nozzle plate. In this embodiment, the inkjet printhead is designated as 20A and the nozzle plate is designated as 31. As in the above-described embodiments, a vaporization cavity (designated by the number 33) is defined by the nozzle plate 31, by a substrate 34, and by an intermediate layer 35. Also as in the above-described embodiments, a heater resistor 37 of the thin-film type is mounted in the vaporization cavity. In contrast to the above-described embodiments, however, heater resistor 37 is mounted on the undersurface of nozzle plate 31, not on substrate 34.

At this juncture, it can be appreciated that the above-described vaporization cavities can also be formed by photo-ablation, as shown in FIG. 5. More particularly, vaporization cavities of selected configurations can be formed by placing a metal lithographic mask such as mask 46 in FIG. 5, over a layer of polymer and then photo-degrade polymer layer with the laser light such as from laser 48 in FIG. 5, in the areas that are unprotected by the lithographic mask. In practice, the polymer layer can be bonded to, or otherwise formed adjacent to, a nozzle plate.

Figure 4:
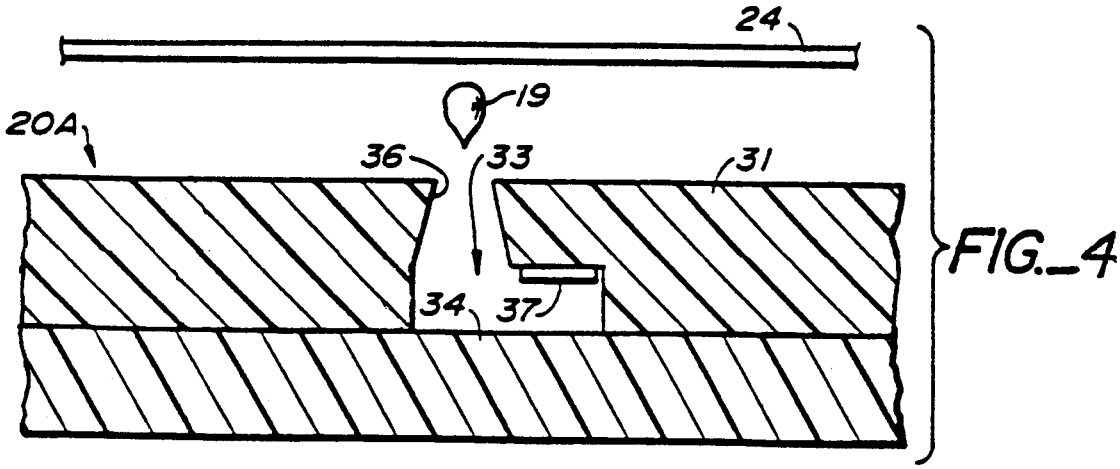
FIG. 4 illustrates a modification to the printhead of FIG. 3 where a nozzle plate and intermediate layer are formed as a unitary layer.

The foregoing has described the principles, preferred embodiments and modes of operation of the present invention. However, the invention should not be construed as being limited to the particular embodiments discussed. For example,, the printhead shown in FIG. 3 can be modified as shown in FIGS. 4 and 5 to eliminate the substrate and, instead, the nozzle plate and intermediate layer can be formed together as a unitary layer which is laminated or co-extruded from a photo-ablatable material. As another example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of present invention as defined by the following claims.

What is claimed is:

1. A step-and-repeat process for forming a nozzle member for an ink printer comprising the steps of:

forming ink orifices in a strip of flexible tape using laser ablation; and forming a fluid communication channel in said flexible tape, using laser ablation, through only a portion of a thickness of said flexible tape to enable fluid communication between said ink orifices and an ink reservoir, wherein said step of forming said ink orifices comprises the steps of:

unreeling said strip of flexible tape from a reel to be in a predetermined position relative to a source of laser radiation;

providing a first masking means between said source of laser radiation and said tape, said first masking means including a pattern corresponding to said ink orifices;

exposing said tape to laser radiation through said first masking means, said first masking means being physically spaced from said tape;

and wherein said step of forming said fluid communication channel comprises the steps of:

providing a second masking means between a source of laser radiation and said tape, said second masking means including a pattern corresponding to vaporization chambers, each vaporization chamber being associated with an ink orifice; and exposing said tape to laser radiation through said second masking means, said vaporization chambers extending through only a portion of a thickness of said tape.

2. The process of claim 1 wherein said flexible tape comprises a polymer material.

3. The process of claim 1 further comprising the step of:

attaching a plurality of heater resistors to a surface of said nozzle member, each of said heat resistors being associated with one of said ink orifices.

* * * * *